US011957293B2

(12) United States Patent
Lin

(10) Patent No.: US 11,957,293 B2
(45) Date of Patent: Apr. 16, 2024

(54) TELESCOPIC SHOE DRYING DEVICE

(71) Applicant: Chengchuan Lin, Fujian (CN)

(72) Inventor: Chengchuan Lin, Fujian (CN)

(73) Assignee: Chengchuan Lin, Fujian (CN)

( * ) Notice: Subject to any disclaimer, the term of this patent is extended or adjusted under 35 U.S.C. 154(b) by 697 days.

(21) Appl. No.: 17/143,143

(22) Filed: Jan. 6, 2021

(65) Prior Publication Data

US 2021/0121043 A1 Apr. 29, 2021

Related U.S. Application Data

(63) Continuation of application No. PCT/CN2019/086301, filed on May 10, 2019.

(30) Foreign Application Priority Data

Jul. 6, 2018 (CN) ..... 201821072855.5
Dec. 29, 2018 (CN) ..... 201822273350.1

(51) Int. Cl.
*A47L 23/20* (2006.01)

(52) U.S. Cl.
CPC ..... *A47L 23/205* (2013.01)

(58) Field of Classification Search
CPC ..... A47L 23/205
USPC ..... 34/104
See application file for complete search history.

(56) References Cited

U.S. PATENT DOCUMENTS 1,522,107 A * 1/1925 Deming ..... A43D 3/1408 220/4.24
2,465,362 A * 3/1949 Elliott ..... A47L 23/20 392/416
3,299,529 A * 1/1967 Roberts ..... A47L 23/205 219/400
4,768,293 A * 9/1988 Kaffka ..... A47L 23/205 392/383

(Continued)

FOREIGN PATENT DOCUMENTS

CN 101278827 A 10/2008
CN 205514475 U 8/2016

(Continued)

OTHER PUBLICATIONS

International Search Report and English Translation as cited in PCT Application No. PCT/CN2019/086301, dated Jul. 19, 2019, 5 pages.

(Continued)

*Primary Examiner* — Stephen M Gravini
(74) *Attorney, Agent, or Firm* — Cooper Legal Group LLC

(57) ABSTRACT

The present disclosure discloses a telescopic shoe drying device comprises a body, and a heater connected to the body. The body comprises a base and a heat supply pipe, the heat supply pipe is disposed on the base, hot air generated by the heater is transported out of the heat supply pipe, the heat supply pipe comprises an inner pipe, an outer pipe, and a locking mechanism. When the at least two locking bases are in the extended position, the locking mechanism is in a locked state and locks the outer pipe and the inner pipe. When the at least two locking bases are in the retracted position, the locking mechanism is in an unlocked state and the outer pipe and the inner pipe are configured to relatively move up and down.

20 Claims, 15 Drawing Sheets

(56) References Cited

U.S. PATENT DOCUMENTS

| | | | | | |
|---|---|---|---|---|---|
| 5,287,636 | A * | 2/1994 | Lafleur | F26B 21/006 | 34/239 |
| 5,555,640 | A * | 9/1996 | Ou | F26B 25/066 | 312/249.9 |
| 2021/0145247 | A1* | 5/2021 | Lin | A47L 23/205 | |
| 2023/0180994 | A1* | 6/2023 | Kim | A47L 23/205 | 34/104 |
| 2023/0233056 | A1* | 7/2023 | Lin | A47L 23/205 | 34/239 |

FOREIGN PATENT DOCUMENTS

| | | | | | |
|---|---|---|---|---|---|
| CN | 108143384 | A | 6/2018 | | |
| DE | 102007006127 | A1 * | 8/2008 | A47L 23/205 | |
| KR | 2005102047 | A * | 10/2005 | A47L 23/205 | |
| WO | WO-2020007121 | A1 * | 9/2020 | | |

OTHER PUBLICATIONS

Written Opinion and English Translation as cited in PCT Application No. PCT/CN2019/086301, dated Jul. 19, 2019, 7 pages.

* cited by examiner

TELESCOPIC SHOE DRYING DEVICE

RELATED APPLICATIONS

This application is a continuation of and claims priority to International Patent Application PCT/CN2019/086301, filed on May 10, 2019, which claims priority to Chinese patent application number 201822273350.1, filed Dec. 29, 2018, and Chinese patent application number 201821072855.5, filed on Jul. 6, 2018. International Patent Application PCT/CN2019/086301, Chinese patent application number 201822273350.1, and Chinese patent application number 201821072855.5 are incorporated herein by reference.

FIELD OF THE DISCLOSURE

The present disclosure relates to household products, and in particular relates to a telescopic shoe drying device.

BACKGROUND OF THE DISCLOSURE

Existing shoe drying devices comprise a main body, a heater, and a fan. The main body comprises a base, a heat supply pipe, and a support. The heat supply pipe is fixedly disposed on the base, and the support is disposed on the heat supply pipe. The heater and the fan are disposed in the main body, and heat from the fan and the heater is output through the heat supply pipe. The heat supply pipe is a single pipe body or a detachable multi-section pipe structure. Existing shoe drying devices have the following technical problems: the existing shoe drying devices are tall or parts of the existing shoe drying devices are easily scattered after disassembly, resulting in poor storage abilities and in a large space being occupied by the existing shoe drying devices. Packaging, storage, and transportation are not convenient.

BRIEF SUMMARY OF THE DISCLOSURE

In order to solve the technical problems, the present disclosure provides a telescopic shoe drying device to solve the deficiencies in the background.

A first technical solution of the present disclosure is as follows.

A telescopic shoe drying device comprises a body, and a heater connected to the body. The body comprises a base and a heat supply pipe, the heat supply pipe is disposed on the base, hot air generated by the heater is transported out of the heat supply pipe, the heat supply pipe comprises an inner pipe, an outer pipe, and a locking mechanism, the outer pipe and the inner pipe encompass each other, the outer pipe and the inner pipe relatively move up and down, the locking mechanism comprises at least two locking bases and an elastic body, the at least two locking bases are connected to the inner pipe and are configured to move in and out, the at least two locking bases move between an extended position and a retracted position relative to the inner pipe, the elastic body is connected to the at least two locking bases to generate elastic force to enable the at least two locking bases to move outward. When the at least two locking bases are in the extended position, the locking mechanism is in a locked state and locks the outer pipe and the inner pipe. When the at least two locking bases are in the retracted position, the locking mechanism is in an unlocked state and the outer pipe and the inner pipe are configured to relatively move up and down.

In an embodiment, the at least two locking bases each comprises a connecting base and an outer convex base secured to an outer wall of the connecting base, and when the at least two locking bases are in the extended position, the outer pipe abuts the outer convex bases.

In an embodiment, when the at least two locking bases are in the extended position, a bottom end face of the outer pipe abuts the outer convex bases.

In an embodiment, an outer peripheral surface of an upper portion of the inner pipe is concave to define an annular groove, the at least two locking bases each comprises a connecting base, the connecting bases cooperate and are slidably disposed in the annular groove, and the at least two locking bases are configured to move in and out relative to the inner pipe.

In an embodiment, the at least two locking bases is two locking bases such that there are two connecting bases, the locking mechanism comprises two elastic bodies, including the elastic body, the two connecting bases each defines a C-shaped structure and comprises two end portions, the two connecting bases are symmetrically disposed, the two elastic bodies are each disposed in the annular groove, and the two elastic bodies abut and are disposed between the two end portions of the C-shaped structures of the two connecting bases.

In an embodiment, the annular groove comprises two groove walls separated up and down, at least one groove wall of the two groove walls comprises a sliding groove, the connecting bases comprise sliding rails, and the sliding rails cooperate and are connected to the sliding groove.

In an embodiment, the annular groove comprises two groove walls separated up and down, at least one groove wall of the two groove walls comprises a matching groove, the connecting bases comprises anti-separation protrusions, and the anti-separation protrusions are disposed in the matching groove.

In an embodiment, the anti-separation protrusions are defined on cantilever arms, and the cantilever arms are defined on the connecting bases.

In an embodiment, the heater is disposed in the body.

A second technical solution of the present disclosure is as follows.

A telescopic shoe drying device comprises a body and a heater. The body comprises a base and a heat supply pipe, the heat supply pipe is disposed on the base, the heater is disposed in the body, hot air generated by the heater is transported out of the heat supply pipe, the heat supply pipe comprises at least two pipes encompassing each other and configured to slide relative to each other, and the at least two pipes define a multi-section telescopic mechanism.

In an embodiment, the at least two pipes comprise three pipes, the three pipes respectively define a lower pipe, a middle pipe, and an upper pipe, the lower pipe is disposed on the base, the middle pipe is slidably connected to the lower pipe, and the upper pipe is slidably connected to the middle pipe.

In an embodiment, the lower pipe is swingably connected to the base.

In an embodiment, the lower pipe is fixedly connected to the base.

In an embodiment, the middle pipe is connected to a first protrusion configured to move between a convex state and a non-convex state relative to the middle pipe, and when the first protrusion is in the convex state, the first protrusion abuts the lower pipe to enable the middle pipe and the lower pipe to be maintained in an extended state.

In an embodiment, the middle pipe is connected to the first protrusion through a first cantilever configured to be elastically deformed relative to the middle pipe.

In an embodiment, the middle pipe comprises a first through hole penetrating an inner side and an outer side of the middle pipe, the first cantilever is disposed in the first through hole, and one end of the first cantilever is secured to an inner wall of the first through hole.

In an embodiment, the first cantilever is disposed with a first pressing portion configured to be pressed by a user. When the middle pipe and the lower pipe are maintained in the extended state, the first pressing portion is disposed out of the lower pipe.

In an embodiment, the upper pipe is concave to define a give-way groove configured to cooperate with the first cantilever and to be pressed by the first pressing portion.

In an embodiment, the middle pipe protrudes to define a first anti-separation protrusion, an inner wall of the lower pipe is disposed with a first shielding portion, and the first anti-separation protrusion cooperates with the first shielding portion to prevent separation from the lower pipe.

In an embodiment, the upper pipe is connected to a second protrusion configured to move between a convex state and a non-convex state relative to the upper pipe. When the second protrusion is in the convex state, the second protrusion abuts the middle pipe to enable an insertion pipe of the upper pipe and the middle pipe to be maintained in an extended state.

In an embodiment, the insertion pipe is connected to the second protrusion through a second cantilever configured to be elastically deformed relative to the upper pipe.

In an embodiment, the upper pipe comprises a second through hole penetrating an inner side and an outer side of the upper pipe, the second cantilever is disposed in the second through hole, and one end of the second cantilever is secured to an inner wall of the second through hole.

In an embodiment, the second cantilever comprises a second pressing portion configured to be pressed by a user. When the upper pipe and the middle pipe are maintained in the extended state, the second pressing portion is disposed out of the middle pipe.

In an embodiment, the upper pipe protrudes to define a second anti-separation protrusion configured to move between a convex state and a non-convex state relative to the upper pipe, the middle pipe comprises a matching groove. When the second anti-separation protrusion is in the convex state, the second anti-separation protrusion is disposed in the matching groove to prevent separation from the middle pipe.

In an embodiment, a connecting mechanism is disposed between two pipes of the at least two pipes configured to slide relative to each other. In the connecting mechanism: an outer peripheral surface of one pipe of the two pipes is concave to define a sliding groove, a sliding base is disposed on the sliding groove, the sliding base comprises a protruding portion, the sliding base is configured to move between an extended state and a retracted state relative to the one pipe. When the protruding portion is in the extended state, the protruding portion abuts a bottom end surface of the other pipe of the two pipes. When the protruding portion is in the retracted state, the protruding portion retracts into the sliding groove.

In an embodiment, an anti-separation structure is disposed between two pipes of the at least two pipes configured to slide relative to each other, the anti-separation structure comprises an insertion member and an insertion groove, the insertion member and the insertion groove cooperate to prevent separation from each other, and the insertion member and the insertion groove are respectively disposed on the two pipes.

In an embodiment, a connecting mechanism is disposed between two pipes of the at least two pipes configured to slide relative to each other. In the connecting mechanism: one pipe of the two pipes is concave to define a sliding groove, a sliding base is slidably connected to the sliding groove, the sliding base is configured to slide in and out relative to the one pipe in a radial direction, the sliding base comprises a protruding portion and an insertion member, the other pipe of the two pipes comprises an insertion groove, the sliding base is configured to move between an extended state and a retracted state relative to the one pipe. When the sliding base is in the extended state, the protruding portion abuts a bottom end surface of the other pipe, and the insertion member cooperates with the insertion groove. When the sliding base is in the retracted state, the protruding portion retracts in the sliding groove, and the cooperation between the insertion member and the insertion groove is released.

Compared with the existing techniques, the technical solution has the following advantages.

The heat supply pipe of the telescopic shoe drying device comprises an inner pipe, an outer pipe, and a locking mechanism. When the locking bases are in the extended position, the locking mechanism is in the locked state and locks the outer pipe and the inner pipe. When the locking bases are in the retracted position, the locking mechanism is in the unlocked state and the outer pipe can move up and down relative to the inner pipe. The heat supply pipe can extend and retract, and the height of the heat supply pipe after retracting is low. The structure is compact, occupies a small space, and is convenient for packaging, storage, and transportation. The locking mechanism can be in the unlocked state by controlling the locking bases to be in the retracted position, the outer pipe can move up and down to extend and retract relative to the inner pipe, and a telescopic operation is convenient.

The locking bases each comprises a connecting base and an outer convex base. When the locking bases are in the extended position, the locking mechanism is in a locked state and the outer pipe abuts the outer convex bases. The support is firm and reliable, and the locking bases are also easy to press.

The connecting base is configured to be slidably connected in the annular groove, and the locking bases can move in and out relative to the inner pipe. The layout is reasonable, the structure is compact, and the connection is firm and reliable.

The connecting base has a C-shaped structure and comprises two end portions. The connecting bases of the two locking bases are disposed symmetrically. The two elastic bodies are disposed in the annular groove, and the two elastic bodies abut the end portions of the C-shaped structures of the two connecting bases. The structure therefore has reasonable layout, compact structure, and firm and reliable connection.

The sliding rail is configured to connect to the sliding groove, and the movement are stable and reliable.

The groove wall comprises a matching groove, and the connecting base comprises an anti-separation protrusion. The anti-separation protrusion is disposed in the matching groove to prevent the locking bases from being separated from the inner pipe.

The anti-separation protrusion is formed on a cantilever arm, and the cantilever arm is formed on the connecting base, so that the anti-separation protrusion can be assembled into the matching groove by the elasticity of the cantilever arm.

The heat supply pipe comprises at least three pipes that can be connected to surround each other and can be relatively slide. The telescopic spacing is large, which is not only convenient for storage, but also enables the telescopic shoe drying device to be used for short boots and has a wide application range.

In the connecting mechanism, the outer peripheral surface of one pipe of the two pipes is concave to define a sliding groove, and a sliding base is disposed on the sliding groove. The sliding base comprises a protruding portion, and the sliding base is configured to move between an extended state and a retracted state relative to the one pipe. When the protruding portion is in the extended state, the protruding portion abuts a bottom end surface of the other pipe of the two pipes. When the protruding portion is in the retracted state, the protruding portion retracts into the sliding groove. The structure is simple and compact, the assembly is convenient, and the telescopic operation is convenient.

The anti-separation structure is disposed between two pipes of the at least three pipes configured to slide relative to each other, and the anti-separation structure comprises an insertion member and an insertion groove. The insertion member and the insertion groove cooperate to prevent separation from each other. When taking out the shoes, the heat supply pipe is prevented from being pulled out, and an application convenience is improved.

In the connecting mechanism: one pipe of the two pipes is concave to define a sliding groove, and a sliding base is slidably connected to the sliding groove. The sliding base is configured to slide in and out relative to the one pipe in a radial direction, and the sliding base comprises a protruding portion and an insertion member. The other pipe of the two pipes comprises an insertion groove. The sliding base is configured to move between an extended state and a retracted state relative to the one pipe. When the protruding portion is in the extended state, the protruding portion abuts a bottom end surface of the other pipe, and the insertion member cooperates with the insertion groove of the other pipe. When the protruding portion is in the retracted state, the protruding portion retracts into the sliding groove. The connecting mechanism can not only achieve a connection of the two pipes but also prevents the two pipes from separating.

DETAILED DESCRIPTION OF THE EMBODIMENTS

Figure 1:
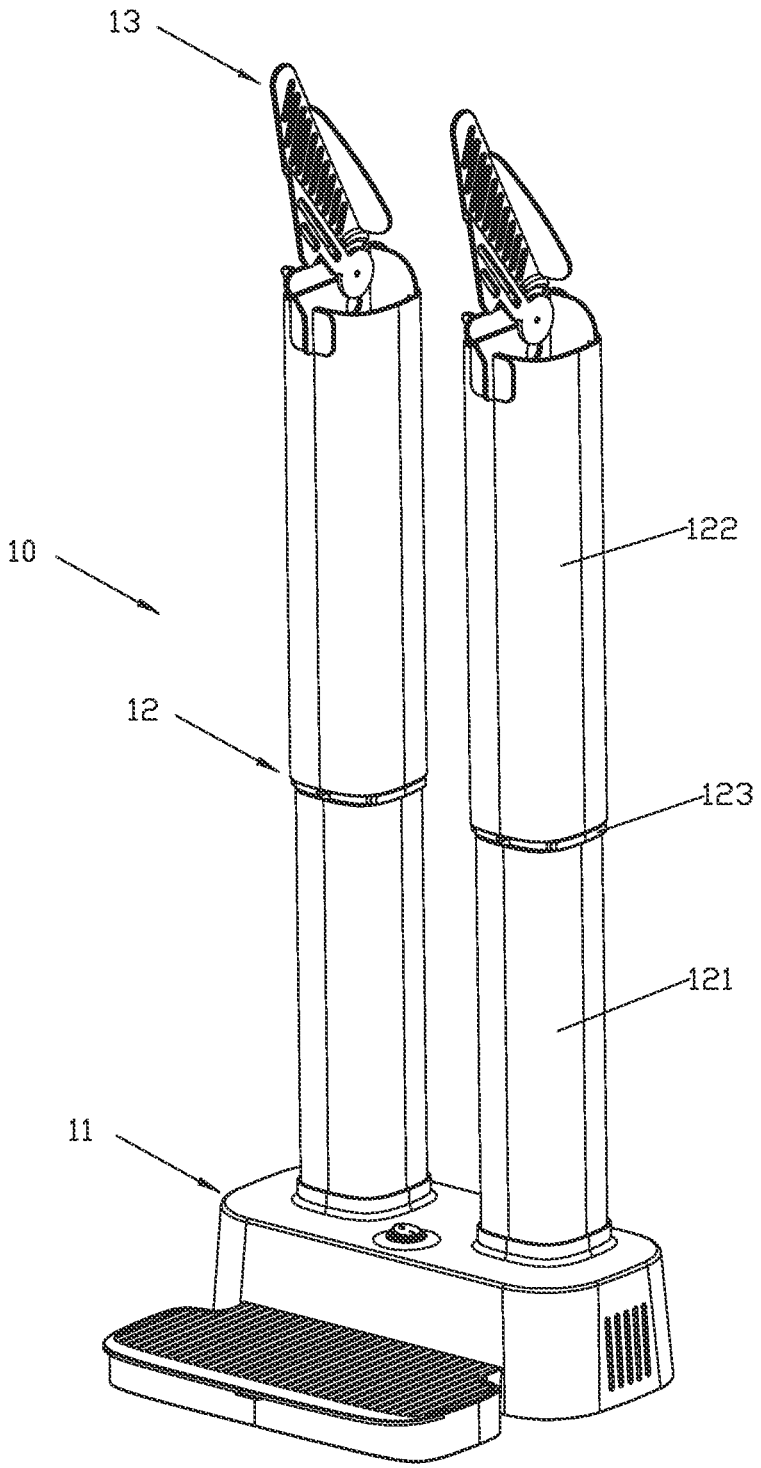
FIG. 1 illustrates a first perspective view of a telescopic shoe drying device of Embodiment 1 when a heat supply pipe is in an extended state.

The present disclosure will be further described below in combination with the accompanying drawings and embodiments.

Embodiment 1

Referring to FIGS. 1-4, a telescopic shoe drying device comprises a body 10, a heater 20, and a fan 50. The heater 20 and the fan 50 are connected to the body 10. The body 10 comprises a base 11, a heat supply pipe 12, and a support 13. The heat supply pipe 12 is disposed on the base 11, and the support 13 is disposed on the heat supply pipe 12. Hot air generated by the heater 20 is transported out of the heat supply pipe 12 to heat an object to be dried by the fan 50. In some embodiments, the fan 50 is not provided, and the hot air generated by the heater 20 heats the object to be dried through natural convection.

The heat supply pipe 12 comprises an inner pipe 121 disposed on the base 11, an outer pipe 122 encompassing an outer side of the inner pipe 121 and configured to move up and down (i.e., in a vertical direction), and a locking mechanism. The locking mechanism comprises two locking bases 123 (i.e., at least two slide bases) and two elastic bodies 124. The two locking bases 123 are connected to the inner pipe 121 and are configured to move in and out, and the two locking bases 123 are configured to move between an extended position and a retracted position relative to the inner pipe 121. For example, when the two locking bases 123 move in and out, the two locking bases 123 may be brought close to each other or separated from each other, or the two locking bases 123 may move horizontally close to or away from to an axial central line of the inner pipe 121. The two elastic bodies 124 are connected to the two locking bases 123 to generate elastic force to enable the two locking base 123 to move outward. When the two locking bases 123 are in the extended position, the locking mechanism is in a locked state, and the outer pipe 122 abuts the two locking bases 123. When two the locking bases 123 are in the retracted position, the locking mechanism is in an unlocked state, and the outer pipe 122 can move up and down relative to the inner pipe 121. Cross-sections of the inner pipe 121 and the outer pipe 122 define frame-like rectangular structures.

Figure 2:
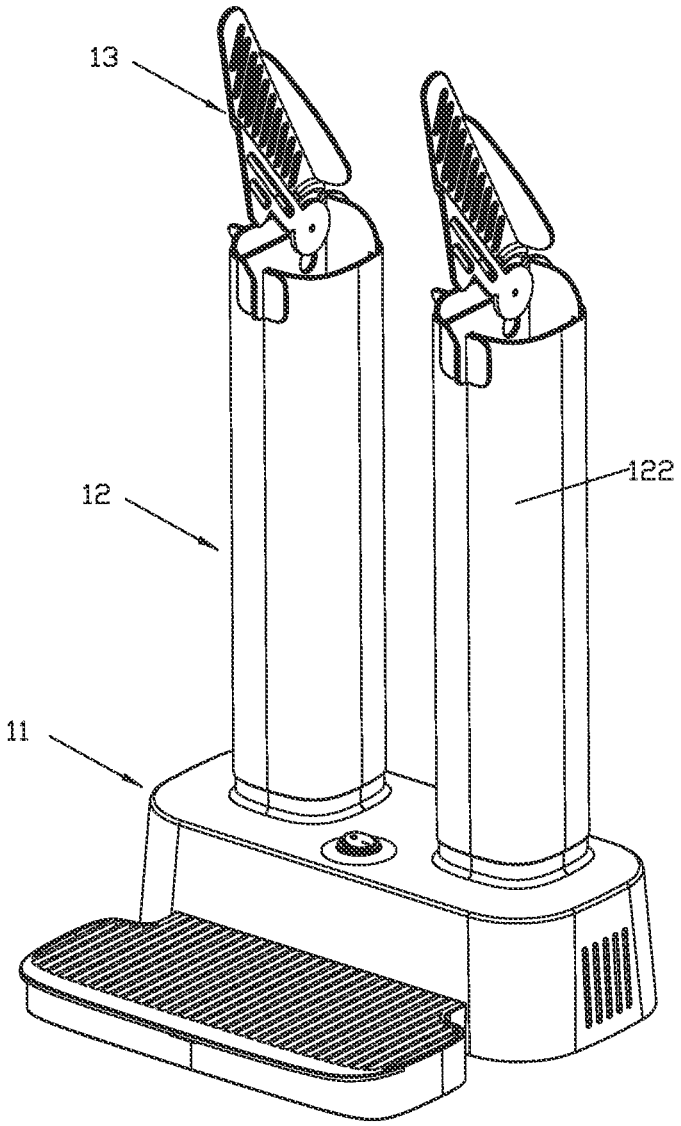
FIG. 2 illustrates a second perspective view of the telescopic shoe drying device of Embodiment 1 when the heat supply pipe is in a retracted state.
Figure 3:
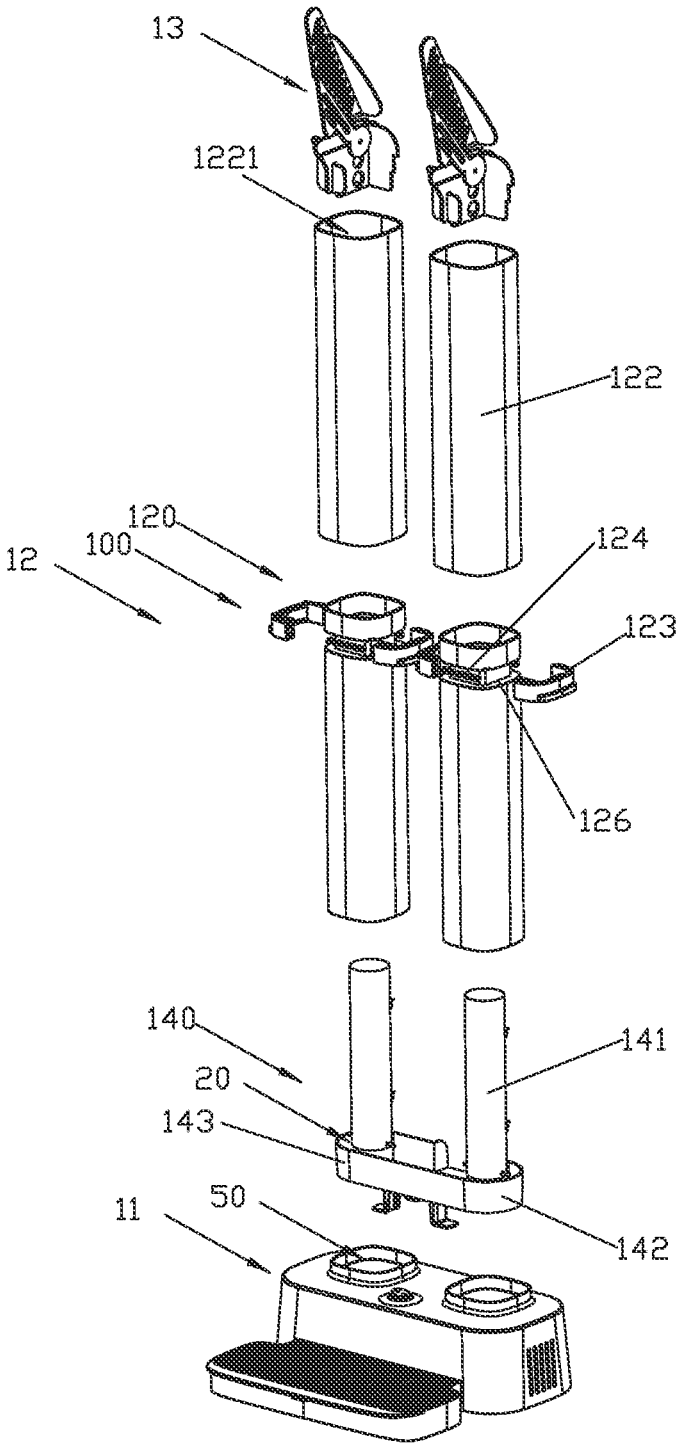
FIG. 3 illustrates an exploded perspective view of the telescopic shoe drying device of Embodiment 1.
Figure 4:
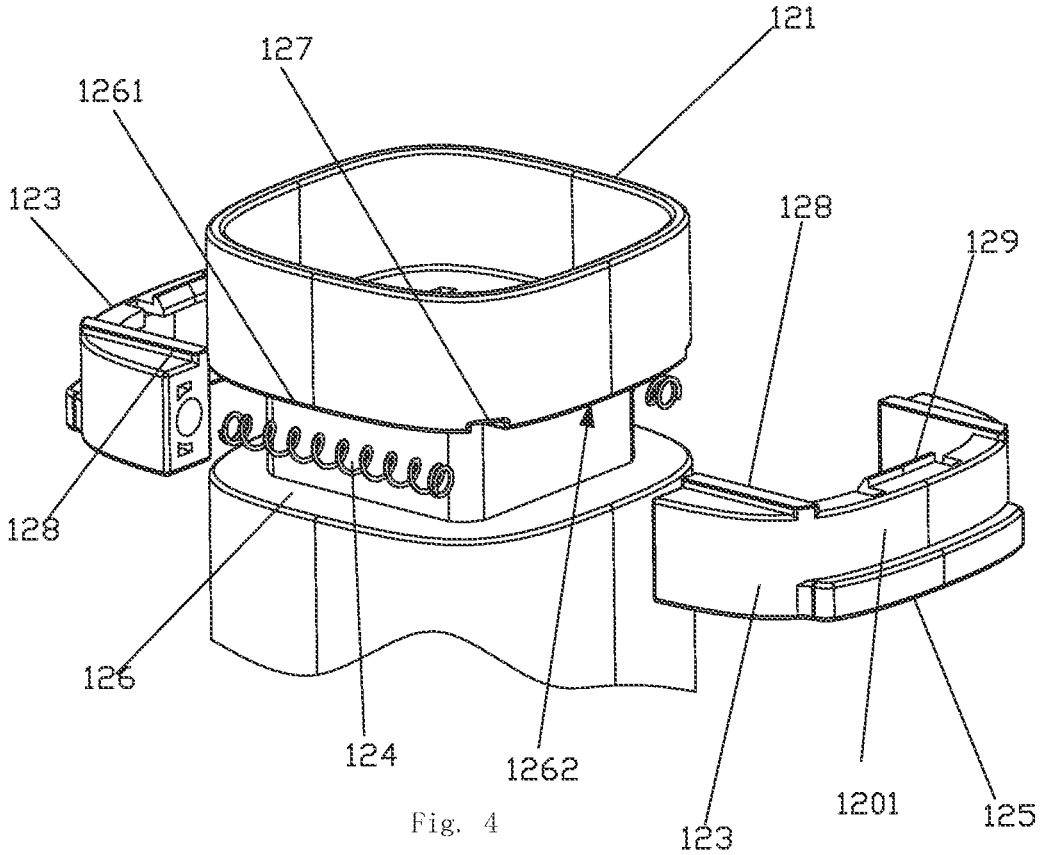
FIG. 4 illustrates a perspective view of a locking mechanism of the telescopic shoe drying device of Embodiment 1.

In this embodiment, the two locking bases 123 each comprises a connecting base 120 and an outer convex base 125 (i.e., a protruding portion) secured to an outer wall of the connecting base 120. When the two locking bases 123 are in the extended position, the locking mechanism is in the locked state, and a bottom end surface of the outer pipe 122 abuts the outer convex bases 125. Referring to FIG. 1, at this time, the heat supply pipe 12 is maintained in the extended state. In some embodiments, the outer pipe 122 can also be disposed with multiple through hole groups disposed up and down at intervals, and the outer convex bases 125 cooperate and are disposed in the multiple through hole groups to enable the outer pipe 122 to abut the two locking bases 123 and to achieve multi-stage adjustment of a telescopic length. Moreover, when the two locking bases 123 are pressed to enable the two locking bases 123 to be in the retracted position, the locking mechanism is in the unlocked state, and the outer pipe 122 is configured to move up and down relative to the inner pipe 121. Referring to FIG. 2, when the outer pipe 122 abuts the base 11, the two locking bases 123 are each disposed in the outer pipe 122, and the heat supply pipe 12 is in a retracted state.

In this implementation, an outer peripheral surface of an upper portion of the inner pipe 121 is concave to define an annular groove 126 (i.e., a sliding groove). The connecting bases 120 each defines a C-shaped structure and comprises two end portions. The connecting bases 120 cooperate and are slidably disposed in the annular groove 126. In some embodiments, the annular groove 126 comprises two groove walls 1261 separated up and down, at least one groove wall of the two groove walls 1261 comprises a sliding groove 127, the connecting bases 120 comprise sliding rails 128, and the sliding rails 128 cooperate and are connected to the sliding groove 127. The two elastic bodies 124 are each disposed in the annular groove 126, and the two elastic bodies 124 abut and are disposed between the end portions of the C-shaped structures of the two connecting bases 120. At least one groove wall of the two groove walls 1261 comprises a matching groove 1262, and the connecting bases 120 comprise anti-separation protrusions 129. The anti-separation protrusions 129 are defined on cantilever arms 1201. The cantilever arms 1201 are defined on the connecting bases 120, and the anti-separation protrusions 129 are disposed in the matching groove 1262. The annular groove 126 and the two locking bases 123 define a connecting mechanism 100.

In this embodiment, the heater 20 comprises a heating component 143 and a heat conducting component 140. The heat conducting component 140 is secured on the base 11, and the inner pipe 121 encompasses an outer side of the heat conducting component. The heating component 143 is disposed on a mounting portion 142, and the mounting portion 142 is disposed in the base 11. The heat conducting component 140 comprises, for example, a heat dissipation pipe 141.

Embodiment 2

Figure 5:
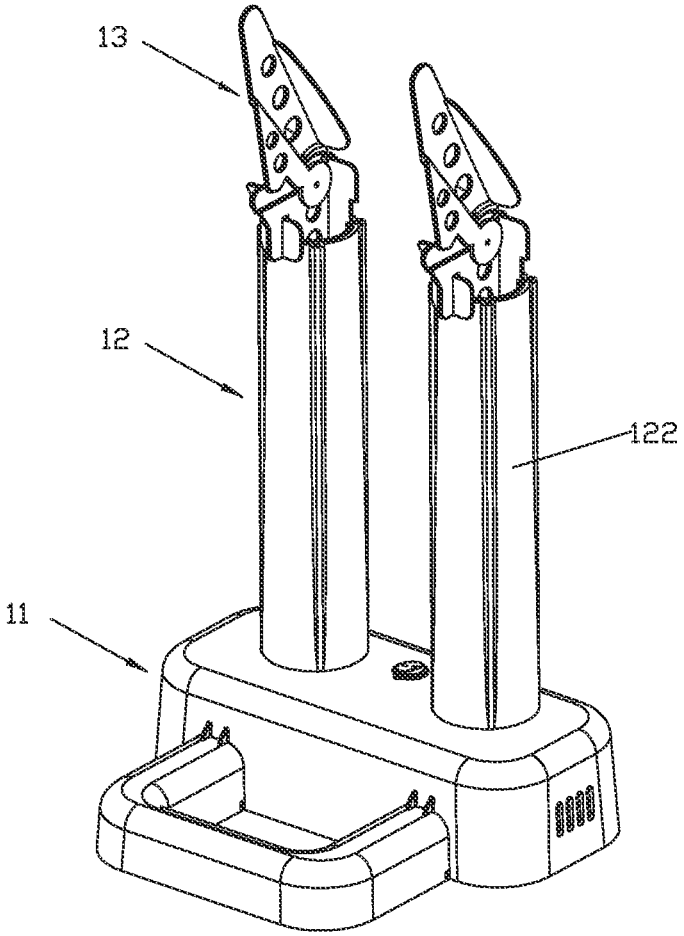
FIG. 5 illustrates a perspective view of a telescopic shoe drying device of Embodiment 2 when a heat supply pipe is in a retracted state.
Figure 6:
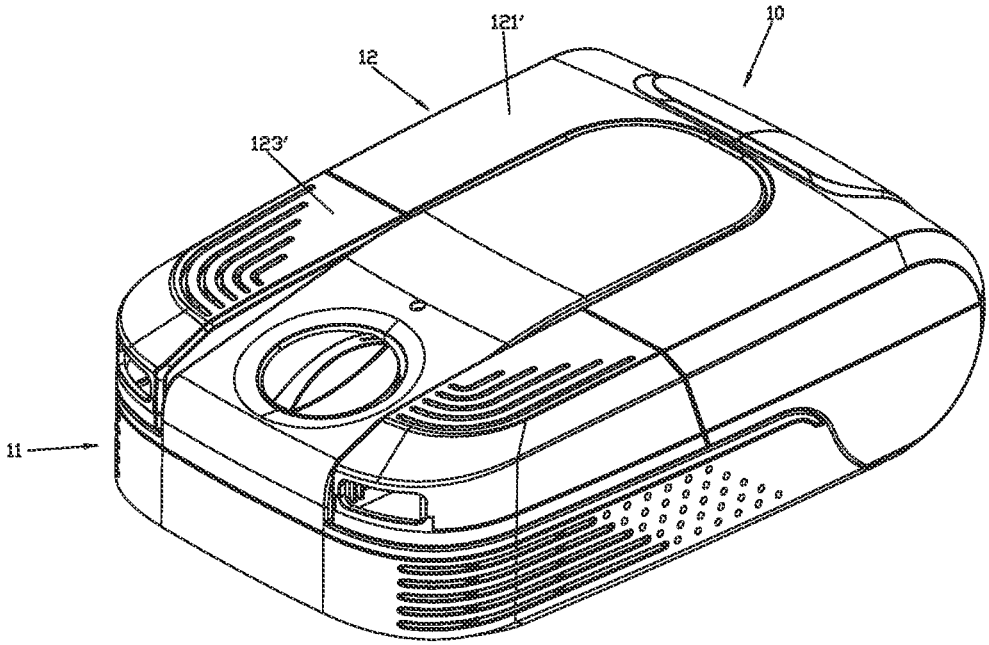
FIG. 6 illustrates a perspective view of a telescopic shoe drying device of Embodiment 3.
Figure 7:
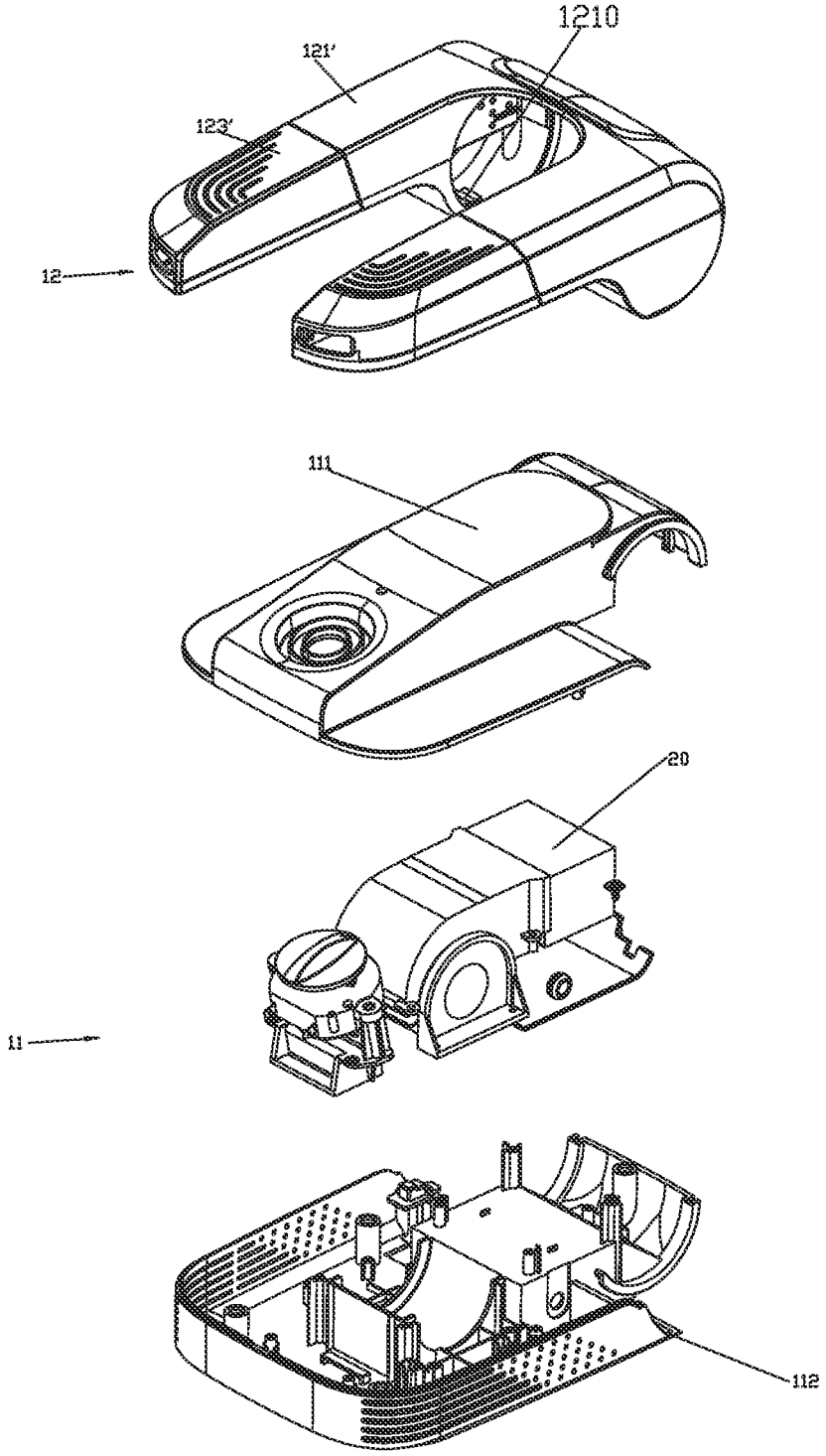
FIG. 7 illustrates an exploded perspective view of the telescopic shoe drying device of Embodiment 3.
Figure 8:
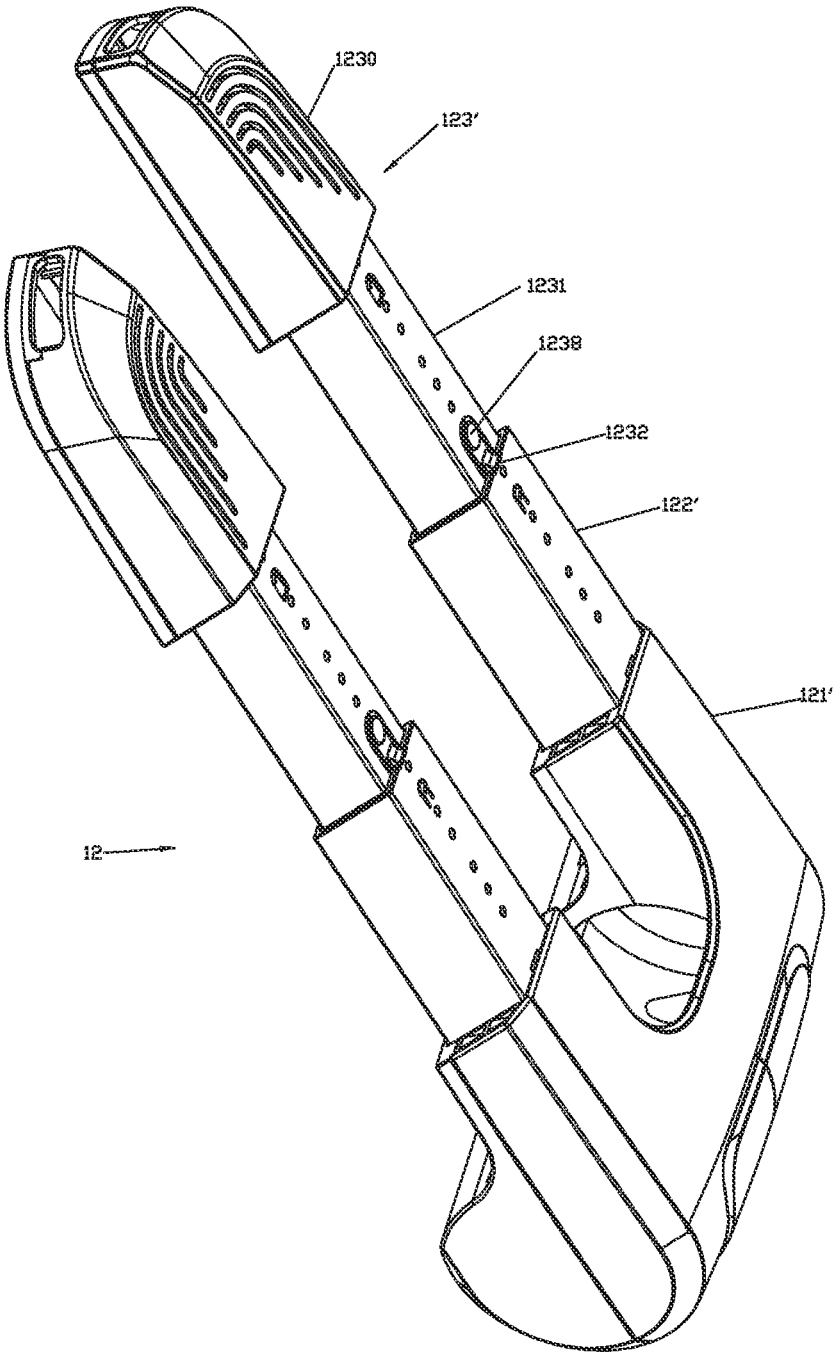
FIG. 8 illustrates a perspective view of a heat supply pipe of the telescopic shoe drying of Embodiment 3 in an extended state.
Figure 9:
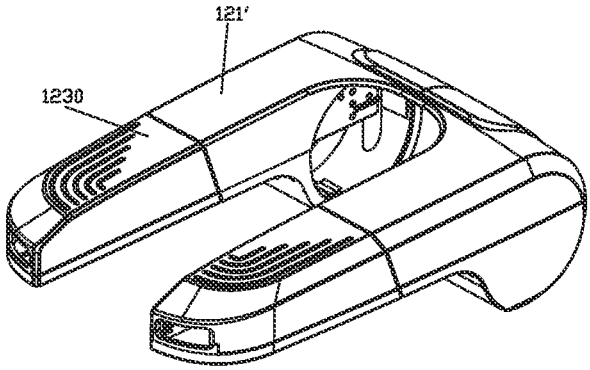
FIG. 9 illustrates a perspective view of the heat supply pipe of the telescopic shoe drying of Embodiment 3 in a retracted state.
Figure 10:
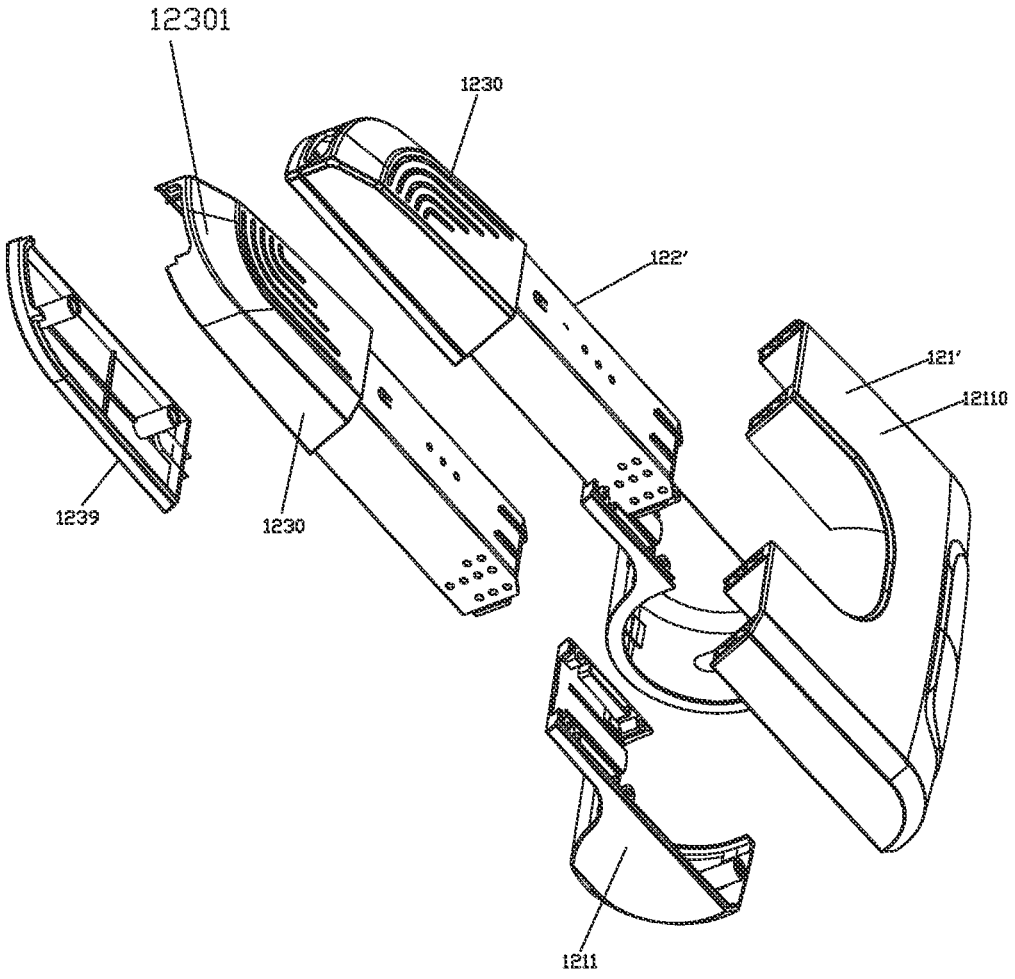
FIG. 10 illustrates a first exploded perspective view of the heat supply pipe of the telescopic shoe drying of Embodiment 3.
Figure 11:
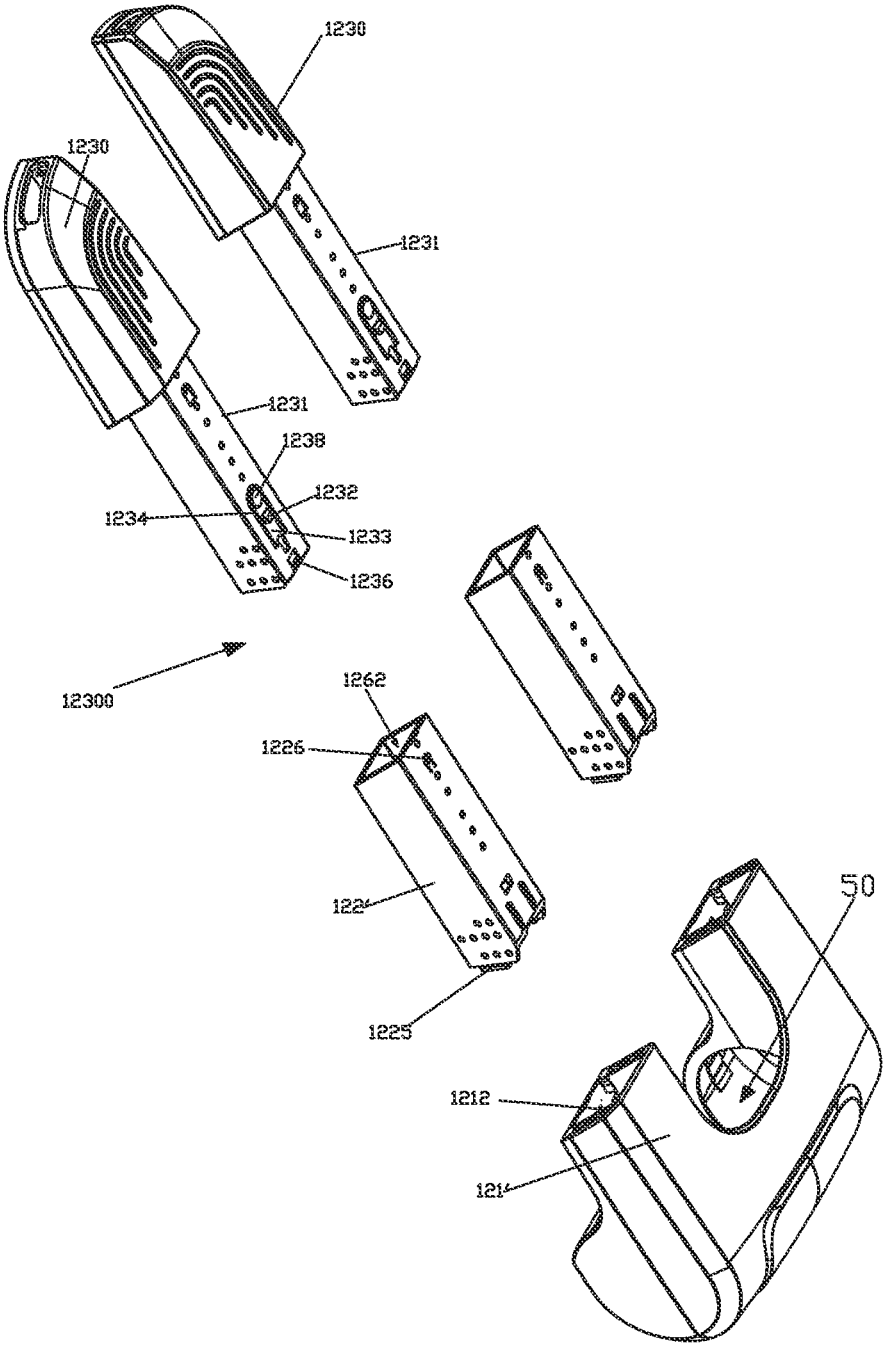
FIG. 11 illustrates a second exploded perspective view of the heat supply pipe of the telescopic shoe drying of Embodiment 3.
Figure 12:
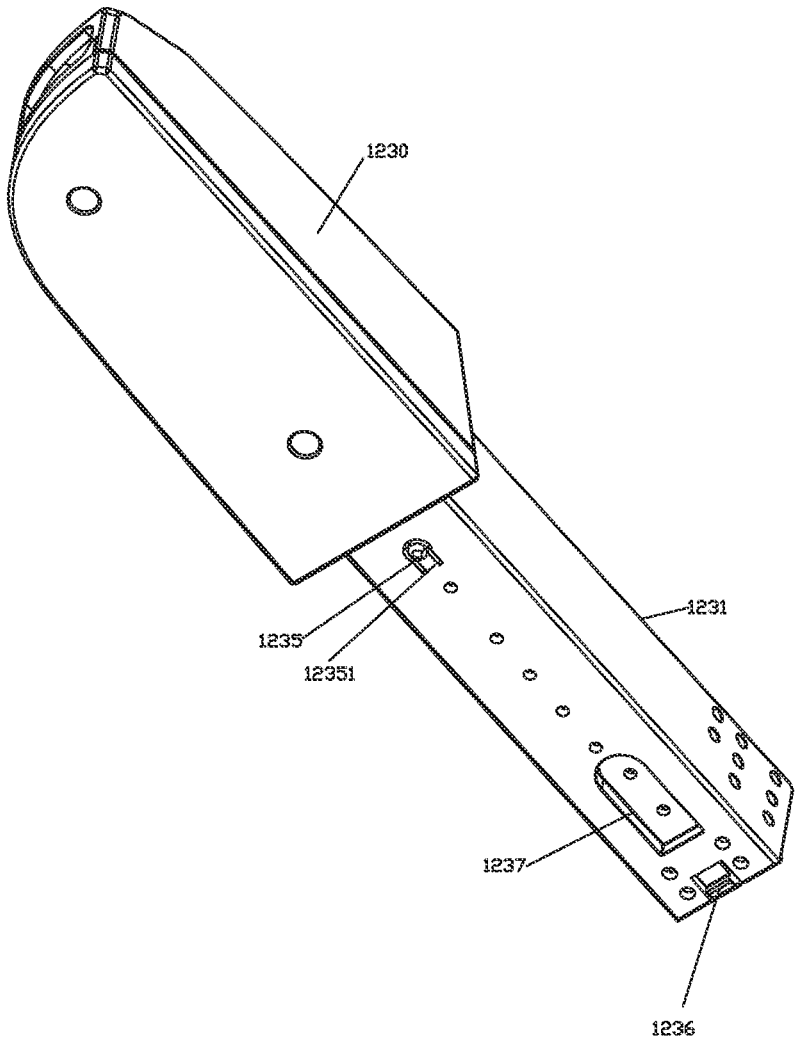
FIG. 12 illustrates a first perspective view of an upper pipe of the heat supply pipe of the telescopic shoe drying of Embodiment 3.
Figure 13:
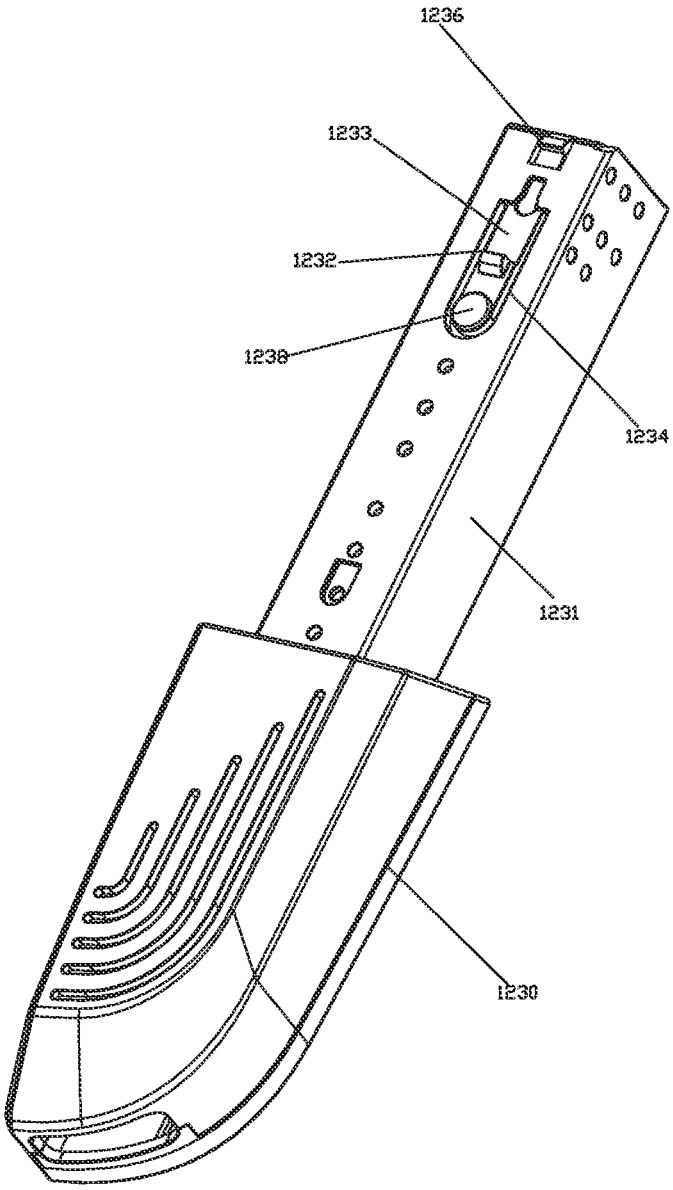
FIG. 13 illustrates a second perspective view of the upper pipe of the heat supply pipe of the telescopic shoe drying of Embodiment 3.
Figure 14:
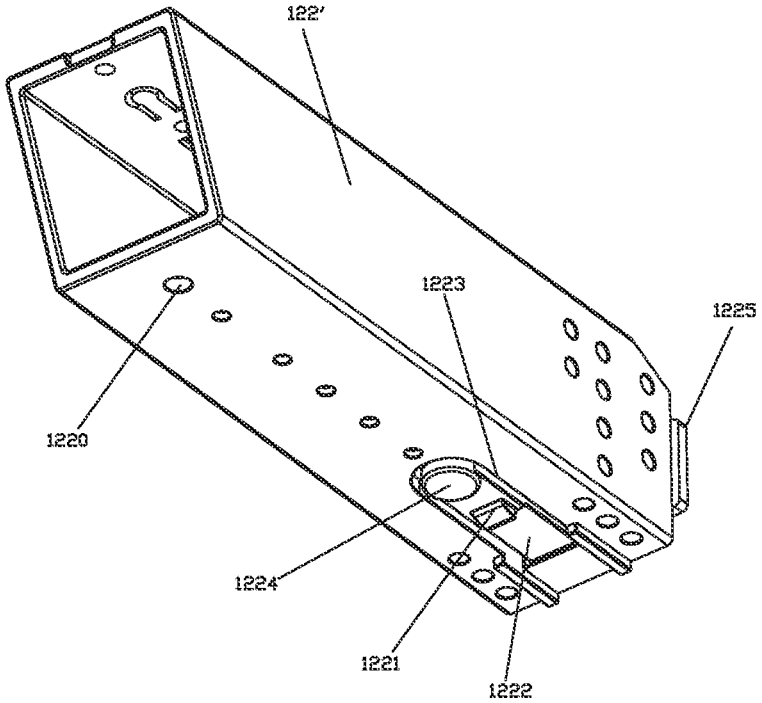
FIG. 14 illustrates a first perspective view of a middle pipe of the heat supply pipe of the telescopic shoe drying of Embodiment 3.
Figure 15:
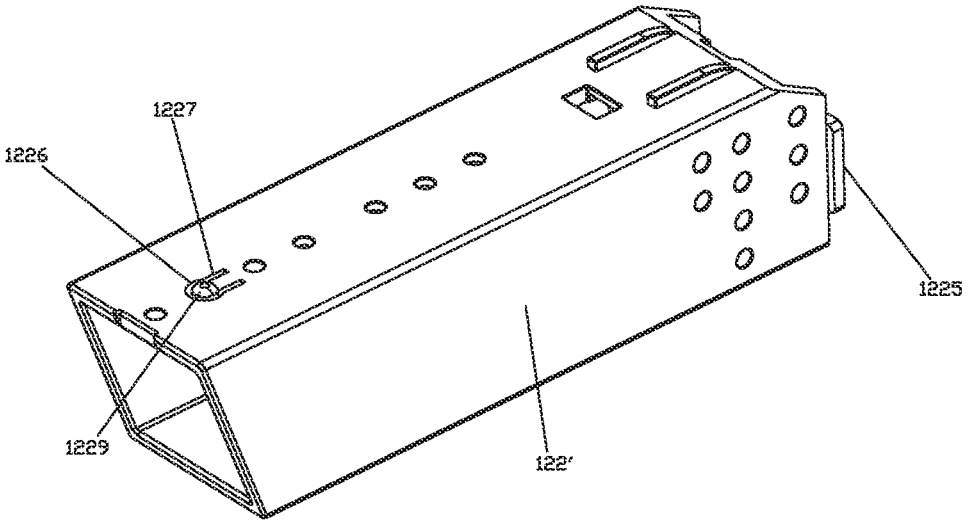
FIG. 15 illustrates a second perspective view of the middle pipe of the heat supply pipe of the telescopic shoe drying of Embodiment 3.

Referring to FIG. 5, this embodiment differs from Embodiment 1 in that the cross-sections of the inner pipe 121 and the outer pipe 122 of Embodiment 1 have frame-like rectangular structures. The cross-sections of the inner pipe 121 and the outer pipe 122 of this embodiment are both circular.

Embodiment 3

Referring to FIGS. 6-15, a telescopic shoe drying device comprises a body 10 and a heater 20. The body 10 comprises a base 11 and a heat supply pipe 12. The heat supply pipe 12 is disposed on the base 11, and the heater 20 is disposed on the body 10. Hot air generated by the heater 20 is transported out of the heat supply pipe 12. The heat supply pipe 12 comprises three pipes encompassing each other and configured to slide relative to each other. The three pipes define a multi-section telescopic mechanism. The three pipes respectively define a lower pipe 121', a middle pipe 122', and an upper pipe 123'. The lower pipe 121' is disposed on the base 11, the middle pipe 122' is slidably connected to the lower pipe 121', and the upper pipe 123' is slidably connected to the middle pipe 122'. In this embodiment, the lower pipe 121' is swingably connected to the base 11 to enable the heat supply pipe 12 to be folded or unfolded relative to the base 11. When in a folded state, the structure of the telescopic shoe drying device is compact, occupies a small amount of space, and is convenient for packaging, transportation, and storage. However, the structure of the telescopic shoe drying device is not limited thereto. For example, the lower pipe 121' can be fixedly connected to the base 11.

The middle pipe 122' is configured to be slidably disposed in the lower pipe 121'. The middle pipe 122' comprises a first protrusion 1221 configured to move between a convex state and a non-convex state relative to the middle pipe 122'. When the first protrusion 1221 is in the convex state, the first protrusion 1221 abuts an end surface of the lower pipe 121' to enable the middle pipe 122' and the lower pipe 121' to be maintained in an extended state. Therefore, extension and retraction of the middle pipe 122' relative to the lower pipe 121' are convenient and support stability is high. In some embodiments, the middle pipe 122' is connected to the first protrusion 1221 through a first cantilever 1222 configured to be elastically deformed relative to the middle pipe 122'. Further, the middle pipe 122' comprises a first through hole 1223 penetrating an inner side and an outer side of the middle pipe 122'. The first cantilever 1222 is disposed in the first through hole 1223, and an end of the first cantilever 1222 is secured to an inner wall of the first through hole 1223. The structure is therefore simple and compact, pressing of the first protrusion 1221 is convenient, the extending and retracting are convenient, and the production cost is low. In order to facilitate the pressing, a first pressing portion 1224 is disposed on the first cantilever 1222. The first pressing portion 1224 is disposed above the first protrusion 1221, and the first pressing portion 1224 is separated from the first protrusion 1221. When the lower pipe 121' and the middle pipe 122' are maintained in the extended state, the first pressing portion 1224 is disposed out of the lower pipe 121' and the pressing is convenient for the user, thereby enabling the user to easily release support and be retracted.

The middle pipe 122' protrudes to define a first anti-separation protrusion 1225, and an inner wall of the lower pipe 121' is disposed with a first shielding portion 1212. The first anti-separation protrusion 1225 cooperates with the first shielding portion 1212 to prevent separation from the lower pipe 121' (i.e., prevent the middle pipe 122' from being separated from the lower pipe 121'), and the structure is simple and reliable. In some embodiments, when the first protrusion 1221 abuts the end surface of the lower pipe 121', the first anti-separation protrusion 1225 abuts the first shielding portion 1212, so that the first anti-separation protrusion 1225 can not only prevent separation but also enable the multi-section telescopic mechanism to be stable and reliable due to a cooperation of this structure.

The upper pipe 123' is disposed with a connecting pipe 1230 and an insertion pipe 1231 secured to the connecting pipe 1230. The insertion pipe 1231 cooperates and is disposed in the middle pipe 122', and the insertion pipe 1231 and the middle pipe 122' define a telescopic sliding connection. The insertion pipe 1231 comprises a second protrusion 1232 configured to move between a convex state and a non-convex state relative to the insertion pipe 1231. When the second protrusion 1232 is in the convex state, the second protrusion 1232 abuts an end surface of the middle pipe 122' to enable the insertion pipe 1231 and the middle pipe 122' to be maintained in the extended state. In some embodiments, the insertion pipe 1231 is connected to the second protrusion 1232 through a second cantilever 1233 configured to be elastically deformed relative to the insertion pipe 1231. Further, the insertion pipe 1231 comprises a second through hole 1234 penetrating an inner side and an outer side of the insertion pipe 1231. The second cantilever 1233 is disposed in the second through hole 1234, and an end of the second cantilever 1233 is secured to an inner wall of the second through hole 1234. An outer wall of the connecting pipe 1230 is aligned with an outer wall of the lower pipe 121'. In order to facilitate pressing by a user, a second pressing portion 1238 is disposed on the second cantilever 1233. The second pressing portion 1238 is disposed above the second protrusion 1232, and the second pressing portion 1238 is separated from the second protrusion 1232. When the upper pipe 123' and the middle pipe 122' are maintained in the extended state, the second pressing portion 1238 is disposed out of the middle pipe 122', and the pressing is convenient for the user, thereby enabling the user to easily release support and be retracted.

The insertion pipe 1231 protrudes to define a second anti-separation protrusion 1236 (i.e., an insertion member) configured to move between a convex state and a non-convex state relative to the insertion pipe 1231, and the middle pipe 122' comprises a matching groove 1262 (i.e., an insertion groove). The insertion member and the insertion groove define an anti-separation structure 12300. When the second anti-separation protrusion 1236 is in the convex state, the second anti-separation protrusion 1236 is disposed in the matching groove 1262 to prevent separation from the middle pipe 122'. The middle pipe 122' comprises a fourth through hole 1226 penetrating an inner side and an outer side of the middle pipe 122', and a fourth cantilever 1227 is disposed in the fourth through hole 1226. An end of the fourth cantilever 1227 is connected to an inner wall of the fourth through hole 1226. The fourth cantilever 1227 cooperates with the second anti-separation protrusion 1236, and the fourth cantilever 1227 abuts the second anti-separation protrusion 1236 to enable the second anti-separation protrusion 1236 to move to the non-convex state. In some embodiments, the inner wall of the fourth cantilever 1227 can comprise the matching groove 1262. An outer wall of the fourth cantilever 1227 is disposed with a pressing head 1229. An operation of the structure is convenient, and the structure is simple and compact.

In this embodiment, the insertion pipe 1231 comprises a third protrusion 1235 configured to move between a convex state and a non-convex state relative to the insertion pipe 1231, and the middle pipe 122' comprises a third through hole 1220. When the third protrusion 1235 is in the convex state, the third protrusion 1235 is disposed in the third through hole 1220 to enable the multi-section telescopic mechanism to be maintained in the retracted state due to a cooperation of the third protrusion 1235 and the third through hole 1220. A structure of the third protrusion 1235 of the insertion pipe 1231 is similar to a structure of the second protrusion 1232 of the insertion pipe 1231. The insertion pipe 1231 is connected to the third protrusion 1235 through a third cantilever 12351 configured to be elastically deformed relative to the insertion pipe 1231.

The base 11 comprises an upper shell 111 and a lower shell 112, and the upper shell 111 is secured to the lower shell 112. The heater 20 is disposed between the upper shell 111 and the lower shell 112. The heater 20 is disposed with a metal heat conduction device 1210 (i.e., a metal heat conduction sheet), the heater 20 and the metal heat conduction device 1210 are secured in the lower pipe 121'. Heat generated by the metal heat conduction device 1210 of the heater 20 blows out of the heat supply pipe 12. In some embodiments, the telescopic shoe drying device can comprise a fan 50. For example, the fan 50 is disposed in the base 11 or the lower pipe 121'. The fan 50 and the heater 20 cooperate to generate hot air. The hot air blows out of a nozzle of the heat supply pipe 12 to transfer heat.

The insertion pipe 1231 is further concave to define a give-way groove 1237 configured to cooperate with the first cantilever 1222 and to be pressed by the first pressing portion 1224. The give-way groove 1237 ensures that the multi-section telescopic mechanism is orderly retracted. For example, the upper pipe 123' and the middle pipe 122' are firstly retracted, and then the combination of the upper pipe 123' and the middle pipe 122' cooperates with the lower pipe 121' to be retracted.

The connecting pipe 1230 comprises a first body 12301 integrated with the insertion pipe 1231 and a first fitting body 1239 configured to be secured to the first body 12301 by screws. The lower pipe 121' comprises a second body 12110 and a second fitting body 1211 configured to be secured on the second body 12110.

In some embodiments, the end of the upper pipe 123' is disposed with the support 13. The support 13 and the heat supply pipe 12 define a detachable connection structure. The telescopic shoe drying device can adapt to support a variety of supports. For example, the support 13 can be a five-finger support configured to be encompassed by gloves, or a shoe support for supporting shoes, or a ball-shaped support for supporting a helmet. The support 13 is convenient to be replaced by the detachable connection structure.

In some embodiments, a connection between the upper pipe 123' and the middle pipe 122' and a connection between the middle pipe 122' and the lower pipe 121' can be formed by the locking mechanism disclosed in Embodiments 1 and 2. In some embodiments, the multi-section telescopic mechanism can comprise four pipes or five pipes.

The aforementioned embodiments are merely some embodiments of the present disclosure, and the scope of the disclosure of is not limited thereto. Thus, it is intended that the present disclosure cover any modifications and variations (i.e., non-substantial variations) of the presently presented embodiments provided they are made without departing from the appended claims and the specification of the present disclosure.

What is claimed is:

1. A telescopic shoe drying device, comprising:

a body, and a heater connected to the body, wherein:

the body comprises a base and a heat supply pipe, the heat supply pipe is disposed on the base, hot air generated by the heater is transported out of the heat supply pipe, the heat supply pipe comprises an inner pipe, an outer pipe, and a locking mechanism, one of the outer pipe or the inner pipe encompasses another of the outer pipe or the inner pipe, the outer pipe and the inner pipe relatively move up and down, the locking mechanism comprises at least two locking bases and an elastic body, the at least two locking bases are connected to the inner pipe and are configured to move in and out, the at least two locking bases move between an extended position and a retracted position relative to the inner pipe, the elastic body is connected to the at least two locking bases to generate elastic force to enable the at least two locking bases to move outward, when the at least two locking bases are in the extended position, the locking mechanism is in a locked state and locks the outer pipe and the inner pipe, and when the at least two locking bases are in the retracted position, the locking mechanism is in an unlocked state and the outer pipe and the inner pipe are configured to relatively move up and down.

2. The telescopic shoe drying device according to claim 1, wherein:

the at least two locking bases each comprises a connecting base and an outer convex base secured to an outer wall of the connecting base, and when the at least two locking bases are in the extended position, the outer pipe abuts the outer convex bases.

3. The telescopic shoe drying device according to claim 2, wherein:

when the at least two locking bases are in the extended position, a bottom end face of the outer pipe abuts the outer convex bases.

4. The telescopic shoe drying device according to claim 1, wherein:

an outer peripheral surface of an upper portion of the inner pipe is concave to define an annular groove, the at least two locking bases each comprises a connecting base, the connecting bases cooperate and are slidably disposed in the annular groove, and the at least two locking bases are configured to move in and out relative to the inner pipe.

5. The telescopic shoe drying device according to claim 4, wherein:

the at least two locking bases are two locking bases such that there are two connecting bases, the locking mechanism comprises two elastic bodies, including the elastic body, the two connecting bases each defines a C-shaped structure and comprises two end portions, the two connecting bases are symmetrically disposed, the two elastic bodies are each disposed in the annular groove, and the two elastic bodies abut and are disposed between the two end portions of the C-shaped structures of the two connecting bases.

6. The telescopic shoe drying device according to claim 4, wherein:

the annular groove comprises two groove walls separated up and down, at least one groove wall of the two groove walls comprises a sliding groove, the connecting bases comprise sliding rails, and the sliding rails cooperate and are connected to the sliding groove.

7. The telescopic shoe drying device according to claim 4, wherein:

the annular groove comprises two groove walls separated up and down, at least one groove wall of the two groove walls comprises a matching groove, the connecting bases comprises anti-separation protrusions, and the anti-separation protrusions are disposed in the matching groove.

8. The telescopic shoe drying device according to claim 7, wherein:

the anti-separation protrusions are defined on cantilever arms, and the cantilever arms are defined on the connecting bases.

9. The telescopic shoe drying device according to claim 1, wherein the heater is disposed in the body.

10. A telescopic shoe drying device, comprising:

a body, and a heater, wherein:

the body comprises a base and a heat supply pipe, the heat supply pipe is disposed on the base, the heater is disposed in the body, hot air generated by the heater is transported out of the heat supply pipe, the heat supply pipe comprises three pipes configured to slide relative to each other, the three pipes define a multi-section telescopic mechanism, the three pipes respectively define a lower pipe, a middle pipe, and an upper pipe, the lower pipe is disposed on the base, the middle pipe is slidably connected to the lower pipe, the upper pipe is slidably connected to the middle pipe, the middle pipe is connected to a first protrusion configured to move between a convex state and a non-convex state relative to the middle pipe, the middle pipe is connected to the first protrusion through a first cantilever configured to be elastically deformed relative to the middle pipe, the middle pipe comprises a first through hole penetrating an inner side and an outer side of the middle pipe, the first cantilever is disposed in the first through hole, one end of the first cantilever is secured to an inner wall of the first through hole, the first cantilever is disposed with a first pressing portion configured to be pressed by a user, the upper pipe is concave to define a give-way groove configured to cooperate with the first cantilever and to be pressed by the first pressing portion, and when the first protrusion is in the convex state relative to the middle pipe:

the first protrusion abuts the lower pipe to enable the middle pipe and the lower pipe to be maintained in an extended state, and the first pressing portion is disposed out of the lower pipe.

11. The telescopic shoe drying device according to claim 10, wherein the lower pipe is swingably connected to the base.

12. The telescopic shoe drying device according to claim 10, wherein the lower pipe is fixedly connected to the base.

13. The telescopic shoe drying device according to claim 10, wherein:

the middle pipe protrudes to define a first anti-separation protrusion, an inner wall of the lower pipe is disposed with a first shielding portion, and the first anti-separation protrusion cooperates with the first shielding portion to prevent separation from the lower pipe.

14. The telescopic shoe drying device according to claim 10, wherein:

the upper pipe is connected to a second protrusion configured to move between a convex state and a non-convex state relative to the upper pipe, an insertion pipe of the upper pipe is connected to the second protrusion through a second cantilever configured to be elastically deformed relative to the upper pipe, the upper pipe comprises a second through hole penetrating an inner side and an outer side of the upper pipe, the second cantilever is disposed in the second through hole, one end of the second cantilever is secured to an inner wall of the second through hole, the second cantilever comprises a second pressing portion configured to be pressed by the user, when the second protrusion is in the convex state relative to the upper pipe:

the second protrusion abuts the middle pipe to enable the insertion pipe of the upper pipe and the middle pipe to be maintained in an extended state, and the second pressing portion is disposed out of the middle pipe.

15. The telescopic shoe drying device according to claim 14 wherein:

the upper pipe protrudes to define a second anti-separation protrusion configured to move between a convex state and a non-convex state relative to the upper pipe, the middle pipe comprises a matching groove, and when the second anti-separation protrusion is in the convex state, the second anti-separation protrusion is disposed in the matching groove to prevent separation from the middle pipe.

16. The telescopic shoe drying device according to claim 10, wherein:

a connecting mechanism is disposed between two pipes of the three pipes configured to slide relative to each other, and in the connecting mechanism:

an outer peripheral surface of one pipe of the three pipes is concave to define a sliding groove, a sliding base is disposed on the sliding groove, the sliding base comprises a protruding portion, the sliding base is configured to move between an extended state and a retracted state relative to the one pipe, when the protruding portion is in the extended state, the protruding portion abuts a bottom end surface of a second pipe of the three pipes, and when the protruding portion is in the retracted state, the protruding portion retracts into the sliding groove.

17. The telescopic shoe drying device according to claim 10, wherein:

an anti-separation structure is disposed between two pipes of the three pipes configured to slide relative to each other, the anti-separation structure comprises an insertion member and an insertion groove, the insertion member and the insertion groove cooperate to prevent separation from each other, and the insertion member and the insertion groove are respectively disposed on the two pipes.

18. The telescopic shoe drying device according to claim 10, wherein:

a connecting mechanism is disposed between two pipes of the three pipes configured to slide relative to each other, in the connecting mechanism:

one pipe of the three pipes is concave to define a sliding groove, a sliding base is slidably connected to the sliding groove, the sliding base is configured to slide in and out relative to the one pipe in a radial direction, the sliding base comprises a protruding portion and an insertion member, a second pipe of the two pipes comprises an insertion groove, the sliding base is configured to move between an extended state and a retracted state relative to the one pipe, when the sliding base is in the extended state:

the protruding portion abuts a bottom end surface of the second pipe, and the insertion member cooperates with the insertion groove, and when the sliding base is in the retracted state:

the protruding portion retracts in the sliding groove, and the cooperation between the insertion member and the insertion groove is released.

19. A telescopic shoe drying device, comprising:

a body, and a heater, wherein:

the body comprises a base and a heat supply pipe, the heat supply pipe is disposed on the base, the heater is disposed in the body, hot air generated by the heater is transported out of the heat supply pipe, the heat supply pipe comprises at least two pipes, one of the at least two pipes encompassing another of the at least two pipe and configured to slide relative to each other, the at least two pipes define a multi-section telescopic mechanism, a connecting mechanism is disposed between two pipes of the at least two pipes configured to slide relative to each other, in the connecting mechanism:

one pipe of the two pipes is concave to define a sliding groove, a sliding base is slidably connected to the sliding groove, the sliding base is configured to slide in and out relative to the one pipe in a radial direction, the sliding base comprises a protruding portion and an insertion member, a second pipe of the two pipes comprises an insertion groove, the sliding base is configured to move between an extended state and a retracted state relative to the one pipe, when the sliding base is in the extended state:

the protruding portion abuts a bottom end surface of the second pipe, and the insertion member cooperates with the insertion groove, and when the sliding base is in the retracted state:

the protruding portion retracts in the sliding groove, and the cooperation between the insertion member and the insertion groove is released.

20. A telescopic shoe drying device according to claim 1, wherein:

the inner pipe is fixed to the base, the outer pipe configured to move up and down encompasses the inner pipe, and when the at least two locking bases are in the extended position, the at least two locking bases abuts the outer pipe.

* * * * *